US010955126B2

(12) United States Patent
Bader et al.

(10) Patent No.: US 10,955,126 B2
(45) Date of Patent: Mar. 23, 2021

(54) ELONGATED LIGHTING ARRANGEMENT WITH SENSOR

(71) Applicant: ZUMTOBEL LIGHTING GMBH, Dombirn (AT)

(72) Inventors: Martin Bader, Dombirn (AT); Wolfgang Bechter, Hittisau (AT); Wolfgang Gadner, Horbranz (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 302 days.

(21) Appl. No.: 15/764,635

(22) PCT Filed: Aug. 24, 2016

(86) PCT No.: PCT/AT2016/060041

§ 371 (c)(1),
(2) Date: Aug. 22, 2018

(87) PCT Pub. No.: WO2017/054023

PCT Pub. Date: Apr. 6, 2017

(65) Prior Publication Data

US 2019/0017690 A1 Jan. 17, 2019

(30) Foreign Application Priority Data

Sep. 30, 2015 (DE) ..... 202015105150.6

(51) Int. Cl.
*F21V 23/04* (2006.01)
*F21S 4/28* (2016.01)
(Continued)

(52) U.S. Cl.
CPC ..... *F21V 23/0464* (2013.01); *F21S 4/28* (2016.01); *F21V 23/0471* (2013.01); *F21Y 2103/10* (2016.08); *F21Y 2115/10* (2016.08)

(58) Field of Classification Search
CPC .. F21V 23/0464; F21V 23/0471; F21V 15/01; F21S 4/28; F21Y 2103/10;
(Continued)

(56) References Cited

U.S. PATENT DOCUMENTS

2006/0262521 A1* 11/2006 Piepgras ..... E04B 9/006 362/149
2010/0061118 A1* 3/2010 Liu ..... F21V 13/02 362/617
(Continued)

FOREIGN PATENT DOCUMENTS

DE 29604199 U1 5/1996
DE 202010009016 U1 2/2012
(Continued)

*Primary Examiner* — Andrew J Coughlin
*Assistant Examiner* — Jessica M Apenteng
(74) *Attorney, Agent, or Firm* — Volpe Koenig

(57) ABSTRACT

The invention relates to a lighting arrangement comprising: a housing (1) extending along a longitudinal axis (L); an LED light source (2) for generating a light, arranged within the housing (1) and extending along the longitudinal axis (L), wherein a lighting outlet opening (3) for the light is delimited by the housing (1); a sensor (4), in particular for detecting a brightness and/or a movement in a vicinity of the lighting arrangement; and a support element (5) for the sensor (4), which is configured to be arranged in the housing (1) in different longitudinal positions relative to the LED light source (2) with respect to the longitudinal axis (L).

9 Claims, 6 Drawing Sheets

(51) Int. Cl.
*F21Y 103/10* (2016.01)
*F21Y 115/10* (2016.01)

(58) Field of Classification Search
CPC ..... F21Y 2115/10; H01L 2224/48091; F21K 9/27; H05B 47/11
USPC ..... 362/217.1
See application file for complete search history.

(56) References Cited

U.S. PATENT DOCUMENTS

| | | | | |
|---|---|---|---|---|
| 2012/0293309 | A1 | 11/2012 | Spiro et al. | |
| 2013/0049598 | A1* | 2/2013 | Nagashima | F21K 9/27 315/113 |
| 2016/0295664 | A1* | 10/2016 | Loster | H05B 45/00 |

FOREIGN PATENT DOCUMENTS

| | | | |
|---|---|---|---|
| DE | 202013000999 | U1 | 3/2013 |
| EP | 2325544 | A1 | 5/2011 |
| WO | 2014135555 | A1 | 9/2014 |

* cited by examiner

Fig. 6
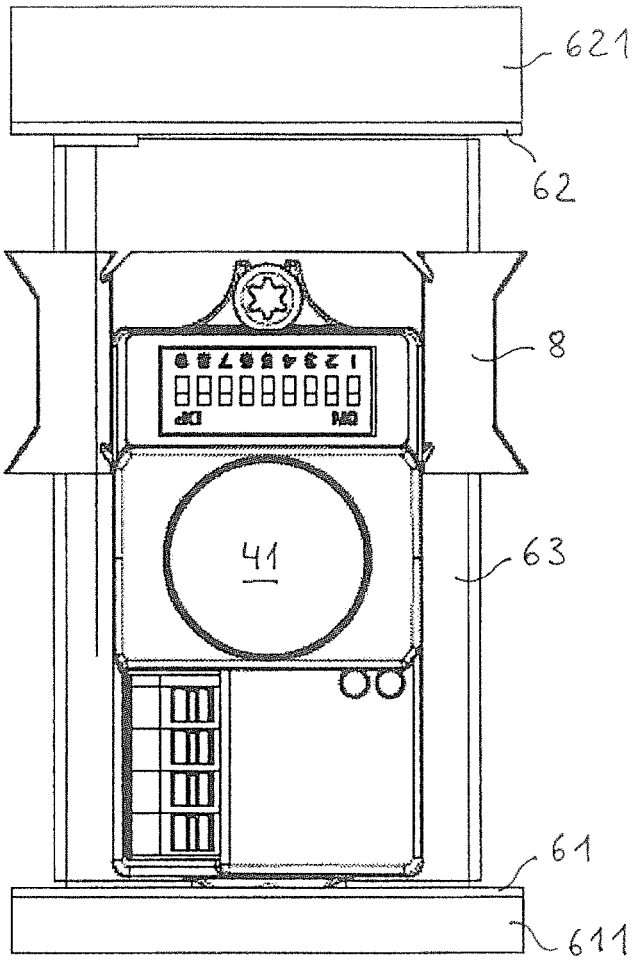
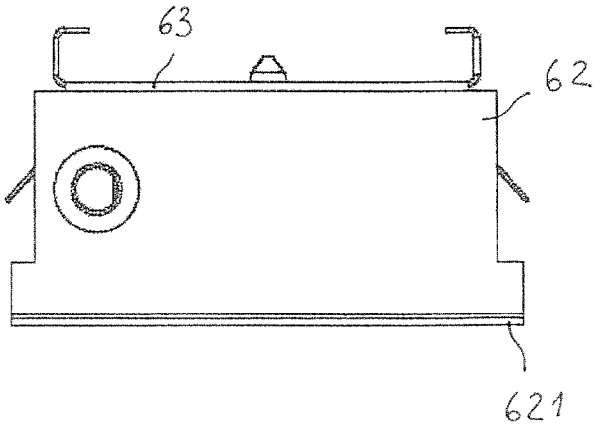
Fig. 7

ELONGATED LIGHTING ARRANGEMENT WITH SENSOR

INVENTIVE FIELD

The invention relates to a lighting arrangement comprising a housing extending along a longitudinal axis, an LED light source (LED: Light Emitting Diode) arranged in it and a sensor, for example a brightness or a motion sensor.

BACKGROUND

From the most recent background art, it is known to mount a brightness or motion sensor, which is used to control a ceiling recessed light with an elongated LED light source, to the ceiling next to the ceiling recessed light in a separate form. By means of this arrangement of the sensor, the design options of the outer appearance of the arrangement are limited. As a general rule, the sensor is perceived as being disturbing with reference to its outer appearance.

If the sensor is integrated into a corresponding ceiling light by being designed as a permanent component of the elongated LED light source, the problem generally exists that, when installing the ceiling light, the sensor cannot be arbitrarily positioned due to the underlying conditions specified by the spatial surroundings. Thereby, the sensor can only be positioned in a certain manner within the room to be illuminated. This principally represents a serious restriction, particularly in the case of a comparably long length of the ceiling light.

In addition, when positioning a corresponding sensor within the light, there is the risk that the signal generated by the sensor, which is formed to control the light, is negatively influenced by the light source located within the light so that the control is consequently modified in an undesired manner.

The object of the invention is to indicate a correspondingly improved lighting arrangement. In particular, the lighting arrangement should have improved characteristics with reference to the sensor.

SUMMARY

In accordance with the invention, this object is solved by means of the object mentioned within the independent claims. Special embodiments of the invention are indicated within the dependent claims.

According to the invention, a lighting arrangement is provided that has a housing extending along a longitudinal axis and an LED light source extending along the longitudinal axis arranged within the housing to generate a light; thereby, a light outlet opening for the light is delimited by the housing. Furthermore, the lighting arrangement has a sensor, in particular for detecting a brightness and/or a movement in a vicinity of the lighting arrangement, and a support element for the sensor, which is configured to be arranged in the housing in different longitudinal positions relative to the LED light source with respect to the longitudinal axis.

In this way, the sensor can be positioned at different points with reference to the longitudinal axis. This is of particular advantage if the lighting arrangement is comparably long, for example a plurality of meters. Here, when mounting the lighting arrangement, it is generally desired to be able to almost freely determine the position of the sensor depending on the respective given underlying conditions at hand.

Preferably, the support element is designed to be arranged in such a way that the sensor is positioned between the LED light source on the one hand and the light outlet opening on the other. In this way, it can be achieved that the sensor can detect a surrounding area of the lighting arrangement in a favorable manner.

Preferably, the support element has a shaded area, by means of which the sensor is shaded from the light of the LED light source. In this way, the risk is reduced that a signal generated by the sensor, which is used for controlling the lighting arrangement, is unfavorably influenced by the light of the LED light source.

Preferably, the shaded area is formed in such a way that it extends on two opposite sides of the sensor—viewed as a longitudinal section parallel to the longitudinal axis. In this way, in particular, corresponding shading on both sides is made possible.

Preferably, the support element comprises a supporting part, more preferably made of a bent sheet-metal part, by means of which the shaded area is formed. This is of advantage with reference to a simple manufacturing option, as well as limiting the components required.

Preferably, the supporting part is designed in such a way that it wraps around the sensor—viewed as a longitudinal section parallel to the longitudinal axis. By means of this, particularly effective shading is made possible.

Preferably, the shaded area has a black surface or is provided with a black surface layer. Light shading is promoted by means of this.

Preferably, the support element is designed to be fixed within the housing. In this way, the sensor can be positioned relative to the housing in an especially suitable manner.

Preferably, the support element comprises a spring element, which is designed to press against a surface area of the lighting arrangement located within the housing to fix the support element within the housing.

Preferably, the spring element is furthermore designed for electrical grounding transmission.

Furthermore, preferably, the lighting arrangement also comprises a foil element, which is arranged positioned between the sensor on the one hand and the light outlet opening on the other. This is favorable with reference to the outer appearance of the lighting arrangement, because the sensor can be practically laminated by the foil element.

Preferably, the foil element is designed in such a way that it—when viewed as a longitudinal section parallel to the longitudinal axis—does not extend, at least in essence, beyond the support element. In this way, it can be avoided that the light generated by the LED light source is weakened by the foil element before exiting the lighting arrangement or that it is modified in any other undesired way.

Furthermore, preferably, the lighting arrangement also comprises a light permeable covering, which is arranged to cover the light outlet opening, wherein the foil element is arranged between the sensor on the one hand and the covering on the other. In this way, it can be achieved that the sensor cannot practically be detected or at least be hardly detected from the outside when the LED light source is switched off.

BRIEF DESCRIPTION OF THE DRAWINGS

The invention is described in the following in detail based on an exemplary embodiment and with reference to the drawings. The figures show.

DETAILED DESCRIPTION OF THE PREFERRED EMBODIMENTS

Figure 1:
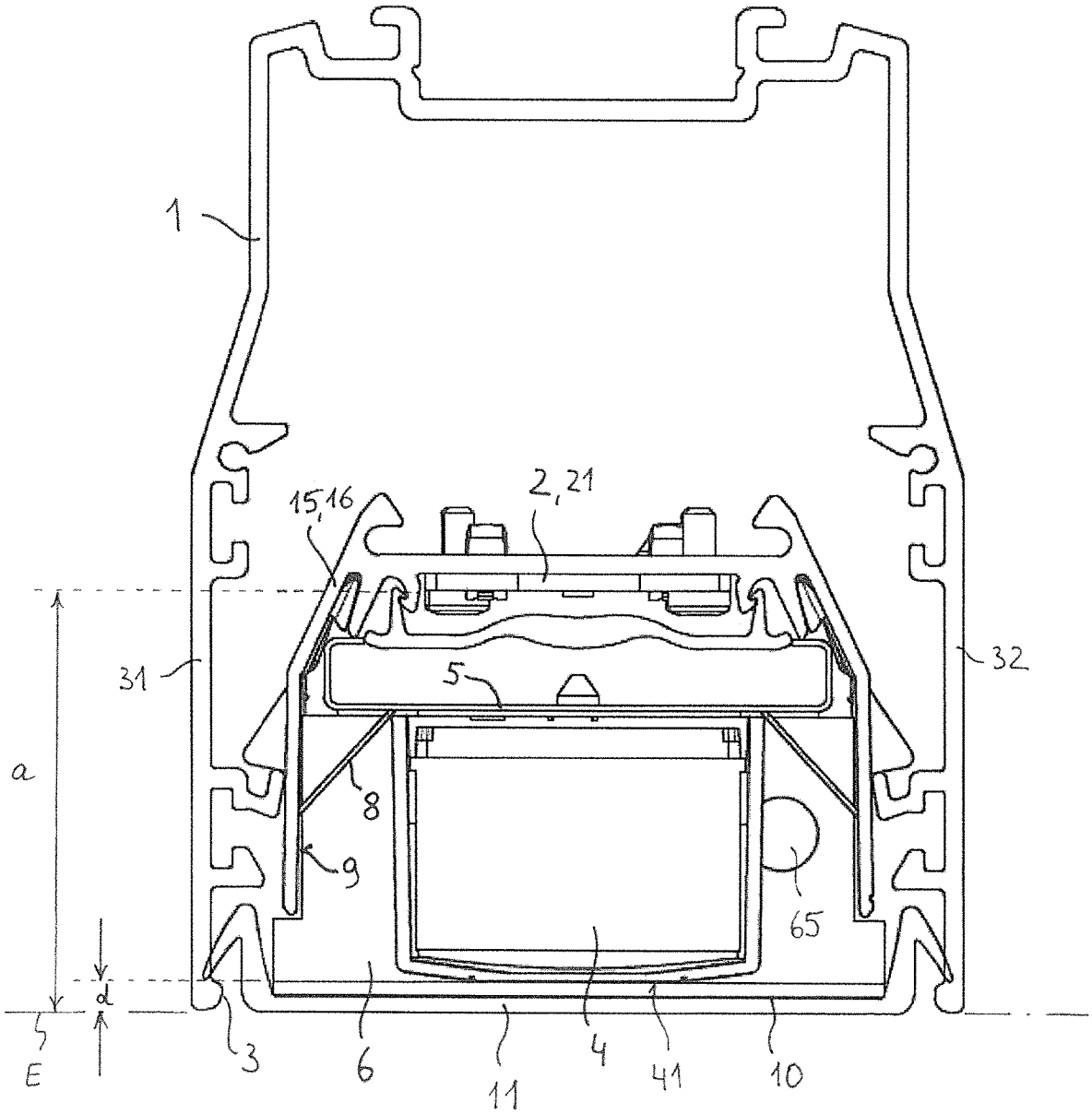
FIG. 1 a cross-sectional drawing of a lighting arrangement according to the invention in the form of a continuous-row lighting system with a light arranged on a mounting rail, FIG. 2 a corresponding cross-sectional drawing of the light separated by the mounting rail, FIG. 3 a perspective view of an area of the light, in which the sensor is arranged, FIG. 4 an exploded view of the sensor and the support element for the sensor, FIG. 5 a view of the sensor and the support element when viewing perpendicularly to the longitudinal axis of the mounting rail, FIG. 6 a corresponding view from below and FIG. 7 a corresponding view in the direction of the longitudinal axis.

FIG. 1 shows a cross-sectional drawing of a lighting arrangement according to the invention. The lighting arrangement comprises one housing 1 extending along a longitudinal axis as well as an LED light source 2 to generate a light, which is arranged within the housing 1 and also extends along the longitudinal axis. Thereby, a light outlet opening 3 for the light is delimited by the housing 1. FIG. 1 shows a cross section normal to the longitudinal axis.

In the case of the exemplary embodiment shown here, the lighting arrangement is given in the form of a continuous-row lighting system, wherein the housing 1 is formed by a particularly profile-shaped mounting rail of the continuous-row lighting system; thereby, the reference number 1 also refers to the mounting rail 1 here accordingly.

Figure 2:
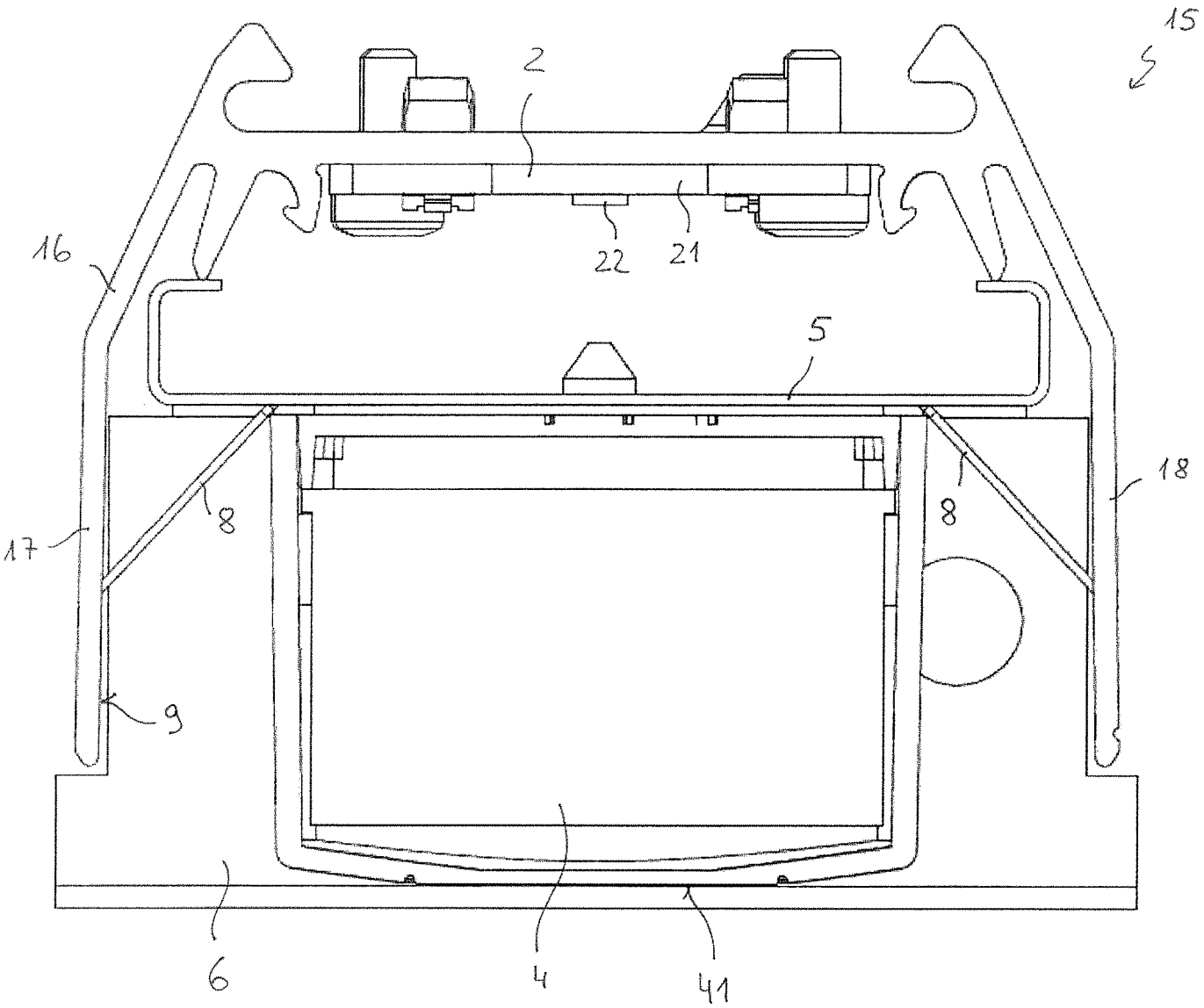

An elongated light 15 extending along the longitudinal axis in the form of a so-called light bar is arranged in the mounting rail 1. Thereby, the LED light source 2 is mounted to the light 15. In FIG. 2, the light 15 is drawn separated from the mounting rail 1 accordingly. The mounting rail 1 can generally extend further than the light 15 when viewed in the direction of the longitudinal axis, wherein, in particular, a plurality of corresponding lights are provided, which can be arranged in the mounting rail 1 in an analogous manner so that the lights form a row extending along the longitudinal axis. A corresponding plurality of mounting rails can also respectively be adjacently arranged on the front so that, overall by means of the continuous-row lighting system, especially long "rows of lights" or "light lines" can be formed.

In the example shown in a cross section, the mounting rail 1 is U-shaped at a first approximation when viewed normal to the longitudinal axis so that a first U-limb 31 of the mounting rail 1 and a second U-limb 32 of the mounting rail 1 are formed. Thereby, the light outlet opening 3 is delimited by both free end areas of both of these U-limbs 31, 32. A plane E is defined by the light outlet opening 3 and both free end areas of the first U-limb 31 and the second U-limb 3 of the mounting rail 1. In the example shown, the LED light source 2 comprises a PCB 21, on which LEDs 22 are arranged, in particular, along the longitudinal axis L forming a row. Thereby, the PCB 21 is preferably aligned in parallel to the plane E, thereby being spaced from this at a distance a.

Furthermore, the lighting arrangement comprises a sensor 4. In the case of the sensor 4, it can, in particular, be a sensor to detect brightness and/or motion within an ambient environment of the lighting arrangement. Furthermore, preferably, a control unit (not shown in the figures) to control the LED light source 2 is provided, wherein it is designed in such a way that a signal generated by the sensor 4 can be transmitted to the control unit and control of the LED light source 2 takes place via the control unit depending on the signal. Since this is well known, it will not be dealt with in further detail at this point.

The sensor 4 can have a sensor surface 41, which can be designed to be approximately flush as in the example shown and which is preferably positioned near the light outlet opening 3 or near plane E in the installed state. For example, the design can be drafted in such a way, that, between the sensor surface 41 and plane E, a distance d is formed, which is clearly smaller that the distance a between plane E and the PCB 21. For example, it can be provided that the following hereby applies: $d<0.25$ a, particularly preferably $d<0.15$ a.

Furthermore, the lighting arrangement comprises a support element 5 for the sensor 4, which is designed to be arranged within the housing 1 or in the mounting rail 1 relative to the LED light source 2 at different longitudinal positions with reference to the longitudinal axis. In this way, the sensor 4 can principally be arranged with the aid of the support element 5 at any point along the LED light source 2. That is advantageous, because it generally depends on the individually given underlying conditions at what point or at what longitudinal position the sensor 4 is desired.

Figure 3:
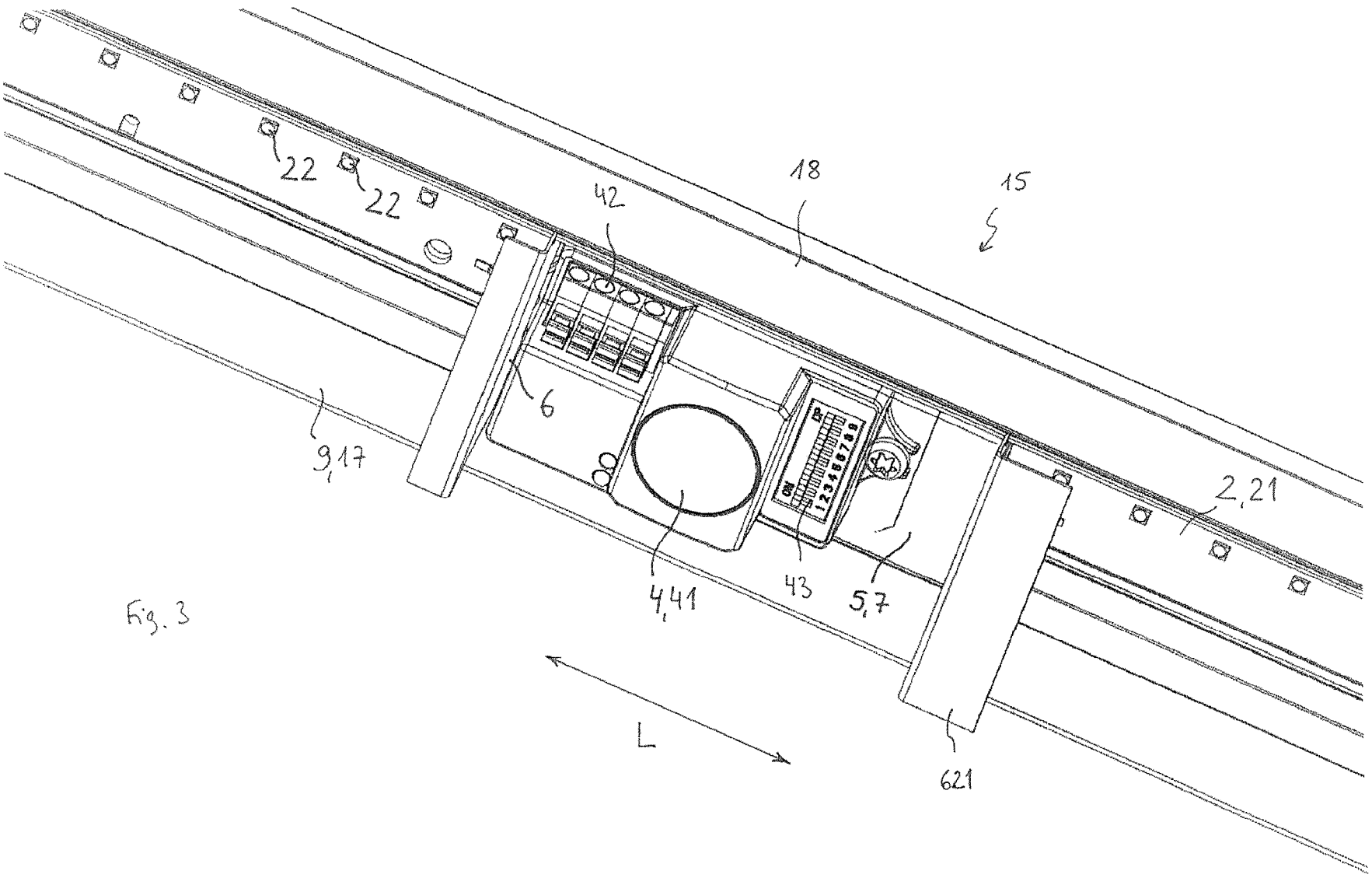

As is drawn as an example in FIG. 1, preferably, the support element 5 is designed to be arranged in such a way that the sensor 4 is positioned between the LED light source 2 on the one hand and the light outlet opening 3 on the other. FIG. 3 shows a perspective view of an area—separated here by the mounting rail 1—of the light 15, in which the sensor 4 is arranged. Here, the longitudinal axis is indicated with the reference L.

In the example shown here, the light 15 has a profile-like light housing 16, which is U-shaped in a first approximation viewed normal to the longitudinal axis L in a cross section so that—as is shown in FIG. 2—a first U-limb 17 of the light housing 16 and a second U-limb 18 of the light housing 16 are formed. The light housing 16 is fully accommodated in the support rail 1 in the example shown. Thereby, both U-limbs 31, 32 of the support rail 1 are at least primarily aligned in parallel to both U-limbs 17, 18 of the light housing 15.

The light 15 can, for example, be arranged in the support rail 1 held by a snap-on connection.

Preferably, the support element 5 has a shaded area 6, by means of which the sensor 4, in particular with its sensor surface 41, is shaded from the light of the LED light source 2.

Figure 4:
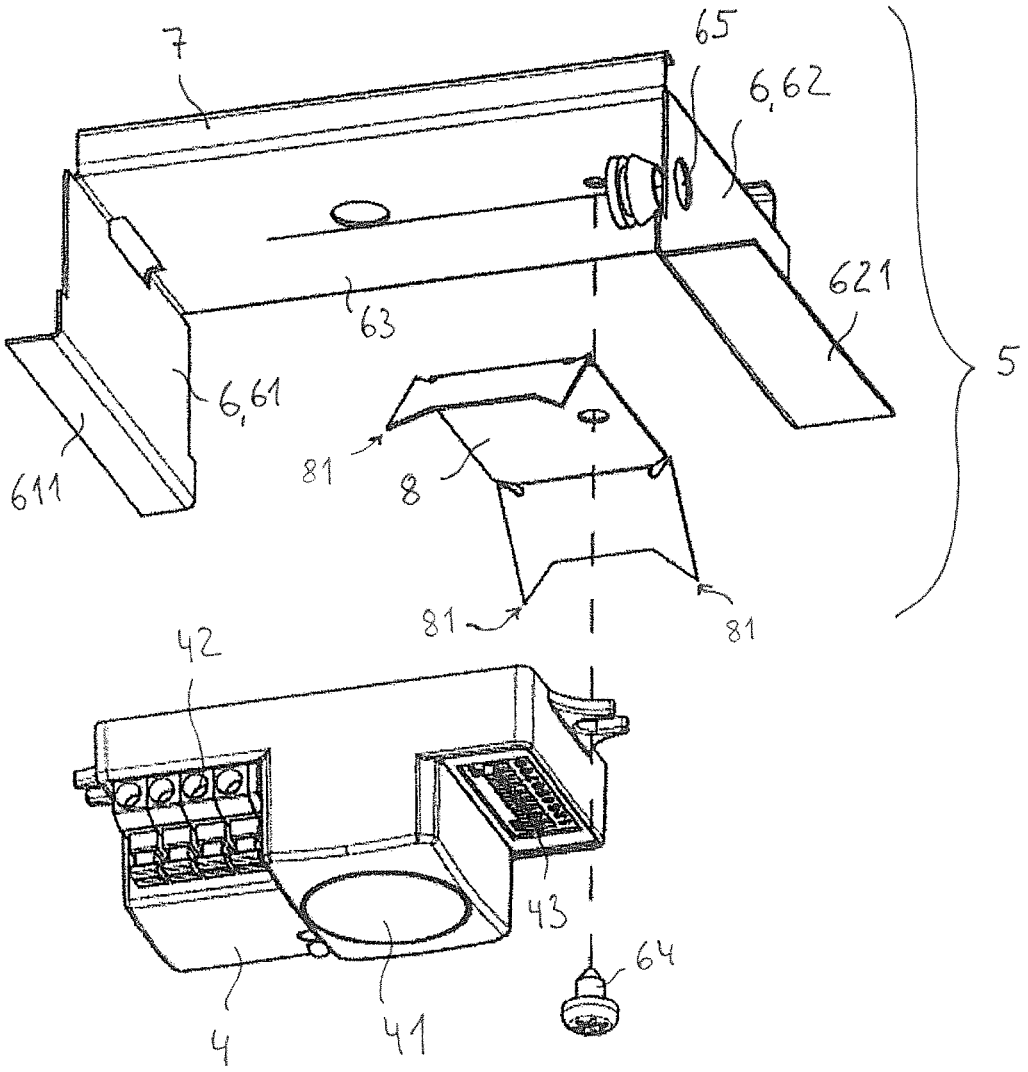

In FIG. 4, an exploded view of the support element 5 and of the sensor 4 is drawn. Preferably, the shaded area 6 is formed in such a way that it extends on two opposite sides of the sensor 4—viewed as a longitudinal section parallel to the longitudinal axis L. In this way, a corresponding shading can be caused on both sides in a suitable manner.

From a technical and manufacturing point of view, it can be advantageous for the support element 5 to comprise a supporting part 7, by means of which the shaded area 6 is formed. Furthermore, from a technical and manufacturing point of view, the supporting part 7 can be manufactured out of a bent sheet-metal part.

Figure 5:
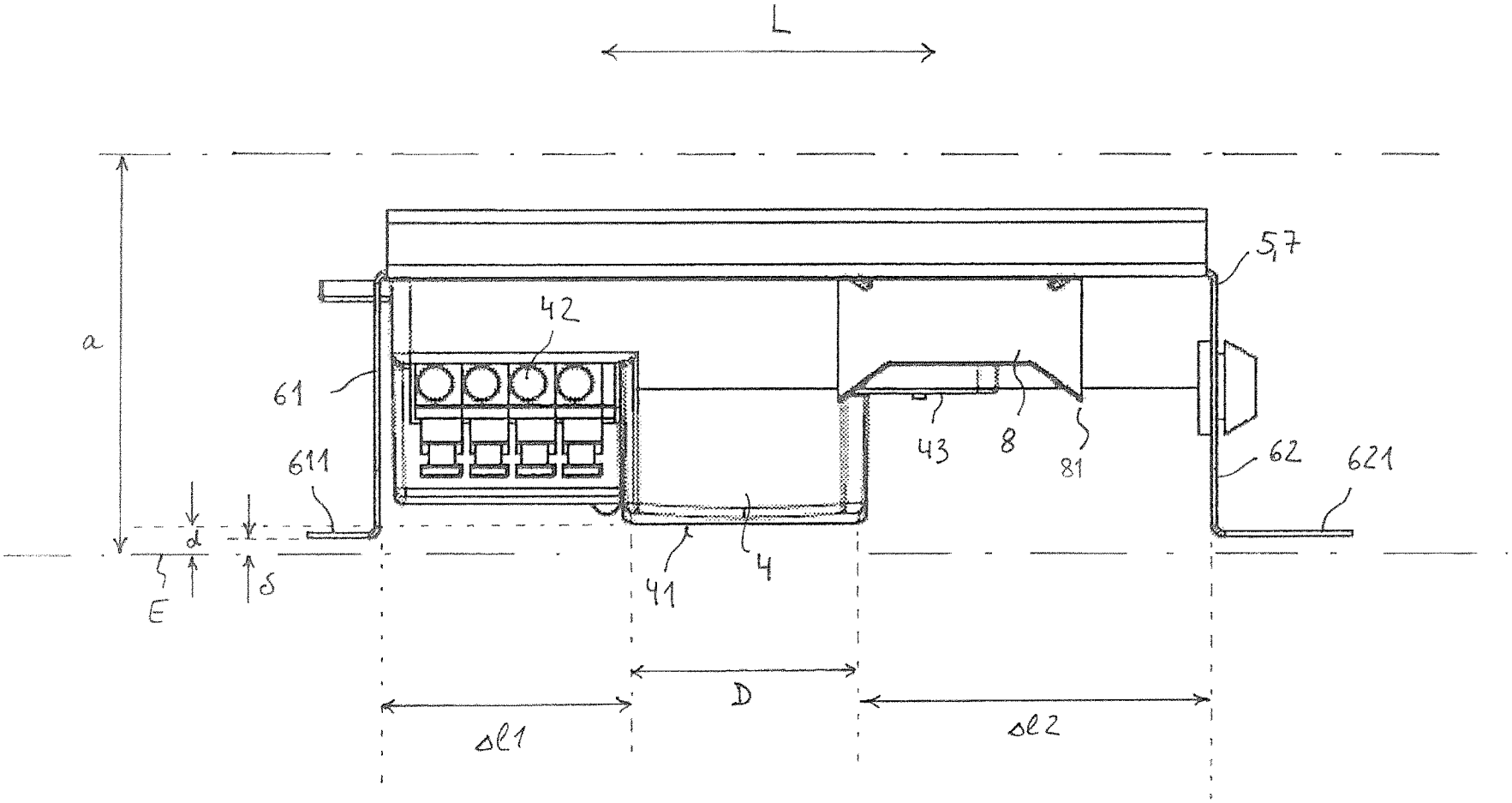

In FIG. 5, a side view of the sensor 4 and of the support element 5, which is aligned normal to the longitudinal axis L and parallel to plane E, is drawn in a separated form; additionally, plane E is drawn to make size proportions clear and the distance of plane E to the PCB 21 of the LED light source 2.

FIG. 6 shows a corresponding view on the support element 5 and the sensor 4 in the direction of view normal to plane E and FIG. 7 shows a corresponding view along the longitudinal axis L. Generally, the continuous-row lighting system is aimed at operating so that U-limbs 31, 32 of the support rail 1 point perpendicularly downwards or plane E is oriented horizontally. In this way, FIG. 6 shows a view "from below".

As can be seen from the figures as an example, the supporting part 7 is preferably designed in such a way that it—viewed in a longitudinal section parallel to the longitudinal axis L—grips around the sensor 4, especially gripping in a U-shaped manner.

For this purpose, the supporting part 7—as can be seen in FIGS. 4 and 5—can have a first limb area 61 and a second limb area 62, that grip around the sensor 4 accordingly. Preferably, the supporting part 7 has in this case a base area 63, across which both limb areas 61, 62 are connected to each other. In the example shown, both limb areas 61, 62 are respectively connected to the base area 63 via a bending edge, which runs orientated perpendicular to the longitudinal axis L. The base area 63 is arranged between the LED light source 2 on the one hand and the sensor 4 on the other—in the installed state of the sensor 4. The base area 63 can be designed to be oriented flush and parallel to plane E in this case.

Preferably, both limb areas 61, 62 extend up until near the light outlet opening 3 or plane E. In particular, the design can be drafted in such a way—as shown in FIG. 5—that a distance δ between the limb areas 61, 62 and plane E is smaller or identical to the distance d between the sensor surface 41 and plane E, preferably fulfilling $\delta<d$. This is of an advantage with reference to particularly effective shading of the sensor surface 41.

Preferably, a distance is also formed along the longitudinal axis L between both limb areas 61, 62 and the sensor surface 41; this is favorably with reference to the desired shading of the sensor surface 41. In particular, such an almost clearly defined "working range" for the sensor 4 can be formed. In the case of a brightness sensor, the surrounding light of the sensor 4 can be precisely detected in this way in a particularly appropriate manner.

In the example shown, between the first limb area 61 and the sensor surface 41, a first longitudinal distance $\Delta l1$ is formed and, between the second limb area 62 and the sensor surface 41, a second longitudinal distance $\Delta l2$ is formed. Thereby, each of the two longitudinal distances $\Delta l1$, $\Delta l2$ is preferably greater than 25% of the distance a between plane E and the PCB 21, especially preferably greater than 40%, however, furthermore, preferably smaller than 150% of the distance a, especially preferably smaller than the distance a. In particular, the design can be in such a way that both longitudinal distances $\Delta l1$, $\Delta l2$ are each at least as long as the extension D of the sensor surface 41 along the longitudinal axis L.

Preferably, the first limb area 61 has a first flange area 611 on its side facing plane E and the second limb area 62 analogously has a second flange area 621, wherein both flange areas 611, 621 respectively extend parallel to plane E; in particular, the flange areas 611, 621 are respectively outwardly aligned, meaning away from each other.

Viewed parallel to the longitudinal axis L, the limb areas 61, 62 preferably clearly extend across the sensor surface 41. As is evident from FIG. 2 as an example, both limb areas 61, 62 extend up to the two U-limbs 17, 18 of the light housing 16 in the example shown. Between the free end areas of both U-limbs 17, 18 of the light housing 16 and plane E, they are preferably widened again.

As is evident from FIG. 4, for example, a screw connection can be provided to hold the sensor 4 to the support element 5. In the example shown, the sensor 4 is attached to the base area 63 of the supporting part 7 by means of a screw 64.

Particularly effective shading can be achieved if the shaded area 6 has a black surface or is provided with a black surface layer, meaning painted black for example.

Preferably, the support element 5 is designed to be fixed within the housing or the support rail 1. Preferably, the support element 5 comprises for this purpose a spring element 8, which is designed to press against a surface area 9 of the lighting arrangement located within the mounting rail 1 to fix the support element 5 in the mounting rail 1. In the exemplary embodiment shown, the surface area 9 is formed by the first U-limb 17 of the light housing 16. (In FIG. 3, the spring element 8 is not drawn in).

Preferably, the spring element 8 is designed in such a way that, in the case of an assembled support element 5, it is permanently hooked into both U-limbs 17, 18 of the light housing 16 so that the support element 5 is held in position by means of the sensor 4 mounted to it, alone by means of this, against the light 15. As is evident from FIG. 4, for this purpose, the spring element 8 can have spikes 81 on two opposite sides, that are provided to hook into both U-limbs 17, 18 of the light housing 16.

Preferably, the spring element 8 is furthermore designed for electrical grounding transmission.

In the example shown, the spring element 9 is attached to the base area 63 of the supporting part 7, preferably by means of a screw 64, with which the sensor 4 is also attached to the supporting part 7.

Furthermore, preferably, the lighting arrangement also comprises a foil element 10, which is arranged between the sensor 4 on the one hand and the light outlet opening 3 on the other. This is favorable with reference to the design possibilities of the outer appearance of the lighting arrangement, because, by means of this, the sensor 4 and the support element 5 can be practically designed in an especially discreet manner.

Preferably, for this purpose, the foil element 10 is designed in such a way that it—when viewed as a longitudinal section parallel to the longitudinal axis L—does not extend, at least in essence, beyond the support element 5. For example, it can be provided that the foil element 10 is shaped in such a way that it extends transversely to the longitudinal axis L viewed from the outer edge of the first flange area 611 up until the outer edge of the second flange area 621.

Furthermore, preferably, the lighting arrangement also comprises a light permeable, preferably opal, covering 11, which is arranged to cover the light outlet opening 3, wherein the foil element 10 is arranged between the sensor 4 on the one hand and the covering 11 on the other. In this way, it can be achieved that the sensor 4 and the support element 5 can practically not be detected when viewed from the outside when the LED light source 2 is switched off. For this reason, the foil element 10 can—depending on the covering 11—be digitally printed in an appropriate manner for example and have a suitable color accordingly.

The foil element 10 is particularly of advantage if the sensor 4 is a motion sensor. In the case of a brightness sensor, the foil element 10 naturally acts unfavorably.

As is shown in FIG. 3 for example, the sensor 4 can furthermore have a cable connection area 42 as well as an operating element area 43, which has operating elements, for example DIP switches to set the sensor's 4 parameters. In the example shown, the cable connection area 42 is arranged between the sensor surface 41 and the first limb area 61 and the operating element area 43 is arranged between the sensor area 41 and the second limb area 62.

In the exemplary embodiment, another bushing 65 is designed for a cable connecting to the sensor 4 in the second limb area 62.

The invention claimed is:

1. A lighting arrangement, comprising a housing (1) extending along a longitudinal axis (L), an LED light source (2) to generate a light, which is arranged within the housing (1) and also extends along the longitudinal axis (L), wherein a light outlet opening (3) for the light is delimited by the housing (1), a sensor (4), to detect brightness or motion or both brightness and motion within an ambient environment of the lighting arrangement, and a support element (5) for the sensor (4), which is designed to be arranged within the housing (1) relative to the LED light source (2) at different longitudinal positions with reference to the longitudinal axis (L) wherein the support element (5) has a shaded area (6), by means of which the sensor (4) is shaded from the light of the LED light source (2), wherein the support element (5) is fixable within the housing (1) and comprises a spring element (8), which is configured to press against a surface area (9) of the lighting arrangement located within the housing (1) to fix the support element (5) within the housing (1) and wherein the spring element (8) is configured for electrical grounding transmission.

2. The lighting arrangement as claimed in claim 1, wherein the support element (5) is configured to be arranged in such a way that the sensor (4) is positioned between the LED light source (2) and the light outlet opening (3).

3. The lighting arrangement as claimed in claim 1, wherein the shaded area (6) is configured in such a way that the shaded area (6) extends on two opposite sides of the sensor (4)—viewed as a longitudinal section parallel to the longitudinal axis (L).

4. The lighting arrangement as claimed in claim 1, wherein the support element (5) comprises a supporting part (7), made of a bent sheet-metal part, by means of which the shaded area (6) is formed.

5. The lighting arrangement as claimed in claim 4, wherein the supporting part (7) is configured in such a way that the supporting part (7) wraps around the sensor (4)—viewed as a longitudinal section parallel to the longitudinal axis (L).

6. The lighting arrangement as claimed in claim 1, wherein the shaded area (6) has a black surface or is provided with a black surface layer.

7. A lighting arrangement, comprising a housing (1) extending along a longitudinal axis (L), an LED light source (2) to generate a light, which is arranged within the housing (1) and also extends along the longitudinal axis (L), wherein a light outlet opening (3) for the light is delimited by the housing (1), a sensor (4), to detect brightness or motion or both brightness and motion within an ambient environment of the lighting arrangement, a support element (5) for the sensor (4), which is designed to be arranged within the housing (1) relative to the LED light source (2) at different longitudinal positions with reference to the longitudinal axis (L) wherein the support element (5) has a shaded area (6), by means of which the sensor (4) is shaded from the light of the LED light source (2); and a foil element (10), which is arranged positioned between the sensor (4) and the light outlet opening (3).

8. The lighting arrangement as claimed in claim 7, wherein the foil element (10) is arranged such that, when viewed as a longitudinal section parallel to the longitudinal axis (L), the foil element (10) does not extend, at least in essence, beyond the support element (5).

9. The lighting arrangement as claimed in claim 7 further comprising a light permeable covering (11), which is arranged to cover the light outlet opening (3), wherein the foil element (10) is arranged between the sensor (4) and the covering (11).

* * * * *